United States Patent [19]

Frenier et al.

[11] Patent Number: 4,636,327

[45] Date of Patent: Jan. 13, 1987

[54] AQUEOUS ACID COMPOSITION AND METHOD OF USE

[75] Inventors: Wayne W. Frenier, Tulsa County, Okla.; David A. Wilson, Brazoria County, Tex.

[73] Assignee: Dowell Schlumberger Incorporated, Tulsa, Okla.

[21] Appl. No.: 728,448

[22] Filed: May 1, 1985

Related U.S. Application Data

[60] Continuation of Ser. No. 526,723, Aug. 26, 1983, abandoned, which is a division of Ser. No. 213,280, Dec. 5, 1980, Pat. No. 4,430,128.

[51] Int. Cl.[4] ..... C23F 11/14

[52] U.S. Cl. ..... 252/87; 252/80; 252/82; 252/142; 134/3; 134/41

[58] Field of Search ..... 252/80, 82, 87, 142; 134/3, 41

[56] References Cited

U.S. PATENT DOCUMENTS

| | | | |
|---|---|---|---|
| 3,438,901 | 4/1969 | Vassilef | 252/82 |
| 3,527,609 | 9/1970 | Vinso | 134/3 |
| 3,664,870 | 5/1972 | Oberhofer et al. | 134/3 |
| 3,721,629 | 3/1973 | Goodenough | 134/3 |
| 4,250,048 | 2/1981 | Leveskis | 134/3 |

FOREIGN PATENT DOCUMENTS

| | | | |
|---|---|---|---|
| 1577582 | 8/1969 | France . | |
| 50-28063 | 9/1975 | Japan | 252/82 |

*Primary Examiner*—Robert A. Wax
*Attorney, Agent, or Firm*—L. Wayne White

[57] ABSTRACT

Aqueous acid compositions are described which comprise (a) hydroxyethylethylenediaminetriacetic acid, and (b) a compatible acid corrosion inhibitor. The compositions are useful in removing iron oxide scale from metal surfaces.

9 Claims, No Drawings

AQUEOUS ACID COMPOSITION AND METHOD OF USE

CROSS-REFERENCE TO RELATED APPLICATION

This is a continuation of application Ser. No. 526,723, filed Aug. 26, 1983, now abandoned, which is a division of Ser. No. 213,280 filed Dec. 5, 1980, now U.S. Pat. No. 4,430,128.

BACKGROUND OF THE INVENTION

1. Field of the Invention

This invention pertains to novel aqueous acid compositions comprising (a) hydroxyethylethylenediaminetriacetic acid (HEDTA), and (b) a compatible acid corrosion inhibitor. This invention also pertains to a method of using such compositions to chemically clean (remove) iron oxide scale from metal surfaces and a method of passivating the clean surface against corrosion.

2. Technology Review

The invention utilizes an organic polycarboxylic acid referred to a hydroxyethylethylenediaminetriacetic acid (abbreviated as HEDTA). This known compound corresponds to the structural formula:

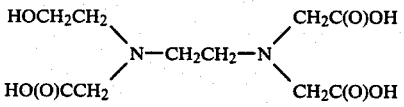

HEDTA is a solid having a melting point of 159° C. and it is soluble in both water and methanol. The ammonium and alkali metal salts of HEDTA are also known.

HEDTA has been used in certain instances as a chelant. The ammoniated or aminated salts of HEDTA have also been used as chelants in removing scale from metal surfaces and for passivating ferrous metal surfaces. These salts were said to be effective against water hardness type scale (i.e. predominantly calcium and/or magnesium salts, such as calcium sulfate, calcium carbonate, etc.) and scales containing a high iron oxide content. See. U.S. Pat. No. 3,308,065 (Lesinski).

A wide variety of other organic polycarboxylic acid have also been used in chemical cleaning and/or for passivating ferrous metal surfaces. The following printed publications are known to Applicant and generally represent the state of the art:

| U.S. Pat. Nos. | |
|---|---|
| 3,072,502 | 3,595,799 |
| 3,308,065 | 3,627,687 |
| 3,413,160 | 3,639,279 |
| 3,438,811 | 3,668,009 |
| 3,438,901 | 3,684,720 |
| 3,492,238 | 3,806,459 |
| 3 510,351 | |
| 3,510,432 | |
| 3,547,697 | |
| Japanese Patents | British Patents |
| J5 0,022,721 | 1,518,321 |
| J5 0,030,928 | 1,182,247 |
| J5 3,125,937 | |
| J7 4,014,629 | |
| J7 8,044,895 | |
| USSR | Belgium |
| 309,072 | 740,608 |
| 567,080 | 803,097 |

-continued

| West Germany |
|---|
| 2,054,067 |

See also: NACE Corrosion '978, Atlanta, Ga. (1978): Papers 38 and 208.

In other instances, organic acids containing acid groups other than carboxylic acid groups have been presented as mimics of polyalkylenepolycarboxylic acid chelants. See, for example, U.S. Pat. No. 3,996,062 were polyalkylenepolyphosphonic acids (and alkali metal or amine salts thereof) are described. It is not known whether or not such systems have been commercialized.

But, returning to the more relevant art, a review of the above patents shown that a variety of ammoniated or aminated polyalkylenepolycarboxylic acids have been described as useful chelants for chemical cleaning. HEDTA is one of the acids named. But this review also indicates that when such compounds are used, the pH is preferably weakly acidic or basic, preferably basic. The use of ammoniated ethylenediaminetetraacetic acid at pH of from about 8.5 to about 10 (as per U.S. Pat. No. 3,308,065, U.S. Pat. No. 3,413,160 and/or U.S. Pat. No. 3,438,811) continues to represent the state of the art from a commercial standpoint.

To applicants knowledge, the prior art does not teach or suggest the invention now described.

SUMMARY OF THE INVENTION

A novel aqueous acid composition has now been discovered which is particularly useful in removing iron oxide scale from ferrous metal surfaces. The novel aqueous acid compositions have a pH of between about 1 and about 3 and comprise (a) hydroxyethylethylenediaminetriacetic acid (HEDTA), and (b) a compatible acid corrosion inhibitor.

The novel compositions are particularly efficient in removing iron oxide scales from metal surfaces. HEDTA forms a chelate with dissolved iron and thus retains the iron in solution during chemical cleaning processes. While the novel compositions can be used in cleaning a variety of iron oxide-containing scales from metal surfaces, it is best suited for removing scales which are predominantly iron oxide. In addition, the "spent" aqueous acid composition can then be used to passivate the ferrous metal surface which is free or substantially free of iron oxide scale. This is accomplished by neutralizing the "spent" acid composition with an aqueous base (e.g. ammonium hydroxide) to a pH of from about 8 to about 10 and adding an oxidizing amount of (1) gaseous oxygen or gaseous air, and (2) an alkali metal nitrite to the composition.

DETAILED DESCRIPTION OF THE INVENTION

As noted above, the essential components of the novel aqueous acid compositions are well known. HEDTA can be prepared by any of several known techniques, but it is preferably prepared by the process described by D. A. Wilson et al. in U.S. Pat. No. 4,212,994. The acid corrosion inhibitors are likewise a known class of compounds, any member of which can be used herein so long as it is compatible with aqueous solutions of HEDTA. I.e. the corrosion inhibitor is soluble in the aqueous solution and it does not substantially retard the efficiency of HEDTA in removing the scale and/or in chelating dissolved iron. The amine-based acid corrosion inhibitors are the most common and are thus preferred from a commercial availability standpoint.

The novel acid compositions, as indicated, have a pH less than about 3. Preferably, the pH of the composition is from aboiut 1 to about 2.

Aqueous solutions of HEDTA usually have a pH of from about 2.2 to about 2.3. The pH of the novel acid compositions can be lowered by adding a compatible nonoxidizing inorganic acid. E.g. hydrochloric acid, sulfuric acid, phosphoric acid, and the like. Sulfuric acid is usually preferred when the composition is to be used in cleaning scale from a ferrous metal surface.

The amounts of HEDTA in the novel acid compositions are bounded only but its solubility. Typically, HEDTA is present in amounts of from about 1 to about 8 weight percent, total weight basis. The amounts of corrosion inhibitor can likewise be varied. Functionally, the corrosion inhibitors will be present in sufficient quantities to inhibit or prevent acid corrosion of clean base metal (i.e. a corrosion inhibiting amount). Typically, the corrosion inhibitors are added in amounts of up to about 1 weight percent, total weight basis.

The novel aqueous acid compositions can be prepared by merely blending the essential components (i.e. water, HEDTA, and corrosion inhibitor). If an inorganic acid is to be included, it is normally added to an aqueous solution of HEDTA (with or without the corrosion inhibitor), according to standard procedures. Alternatively, the novel compositions can be prepared by generating the HEDTA in situ. In such an instance, an aqueous inorganic acid (such as 98 percent $H_2SO_4$) is blended into an aqueous solution of an ammonium or alkali metal salt of HEDTA (again, with or without the corrosion inhibitor present in the solution). It is preferable in such instances to either avoid the formation of a precipitate (e.g. $Na_2SO_4$) by having sufficient water present to dissolve the salts that are formed, or to remove the solid precipitates (e.g. by filtration). The reason for avoiding precipitates is readily apparent when the compositions are to be used in cleaning scale from metal surfaces having an unusual configuration, restriction zones or "valleys" that could be plugged by the solid.

The process of cleaning (i.e. removing) predominantly iron oxide scale from metal surfaces involves contacting such scale encrusted surfaces with the novel aqueous acid compositions for a time sufficient to remove the desired amount of scale. Like most chemical reactions, the rate of scale dissolution is increased at higher temperatures. So while ambient temperatures can be used, the process is preferably conducted at an elevated temperature. The upper temperature is bounded only by the thermal stability of the essential components in the novel compositions and by the capacity or ability of the corrosion inhibitor to function effectively at that temperature. Thus, process temperatures of up to about 200° F. or more are operable, but temperatures of from about 160° to about 180° F. are normally preferred. The reaction rate of scale dissolution is quite acceptable at the preferred temperatures.

After the cleaning process is complete, it is normally desirable to passivate the clean metal surface. This can be accomplished by draining the cleaning composition, rinsing the clean metal surface with water, and then contacting the clean metal surface with a passivating agent. Alternatively, and preferably in many instances, the "spent" aqueous acid compositions can be transformed into a passivating composition for ferrous metal by neutralizing them with an aqueous base (e.g. ammonium hydroxide, NaOH, etc.) to a pH of from about 8 to about 10 and adding an oxidizing amount of gaseous oxygen, gaseous air, and/or an alkali metal nitrite (e.g. sodium nitrite) to the neutralized composition. This can usually be done in situ without any need for the drain and rinse steps. Passivation is usually accomplished by contacting the clean ferrous metal while it is free or substantially free of iron oxide scale with the "spent" aqueous acid composition (as modified) at an elevated temperature. Temperatures of up to about 175° F. are convenient and normally used; and temperatures of from about 150° to about 160° F. are generally preferred. The teachings of Teumac (U.S. Pat. No. 3,413,160) are applicable in this passivating step, and the disclosure by Teumac is incorporated herein by reference.

The presence of an oxidant in the passivating compositions is significant in enhancing the passivation process. The chelated iron in the "spent" aqueous acid composition is usually a mixture of chelated ferrous ($Fe^{+2}$) and ferric ($Fe^{+3}$) ions; a ratio determinable by Teumac's disclosure. Chelated ferric ion, of course, acts as an oxidant in the presence of base metal ($Fe^{o}$), and so the "spent" aqueous acid composition can be neutralized (pH about 8–10) and used in passivation, by adding an oxidant to generate ferric ions. If the solution contains an anion that interferes with passivation (such as the sulfate anion), the "spent" solution must be neutralized (pH about 8 to 10) and oxidized with an oxidizing amount of (1) gaseous oxygen or gaseous air, and (2) an alkali metal nitrite. The passivation process can be monitored by measuring the electrical potentials of the metal surface in the passivating composition, as per Teumac. After passivation is complete, the passivating composition is used, drained and the passivated surface is flushed with water.

In both the cleaning process step and the passivation step, it is advantageous to "circulate the system" so that fresh solution is continually brought to the metal surface.

EXPERIMENTS 1–3

A three weight percent solution of HEDTA in water was prepared by dissolving the required amount of trisodium HEDTA salt in water and then lowering the pH of the solution to 1.6 using 98 percent sulfuric acid. Another solution of HEDTA was prepared by adding sulfuric acid to a three weight percent HEDTA solution in water to bring the pH to 1.2. A commercial amine-based acid corrosion inhibitor (Dowell A175) was then added to each of the HEDTA solutions in amounts sufficient to give an inhibitor concentration of 0.3 weight percent. These aqueous acid HEDTA solutions, with inhibitor, were then evaluated as chemical cleaning solvents for iron oxide scale using the following procedure.

A rusted water pipe having an orginial inside diameter of 0.5 inch was cut into uniform (6 inch) sections. A small closed test loop of stainless steel tubing (0.5 inch inside diameter) and one of the sections of rusted pipe was prepared and equipped with a liquid pumping means to circulate liquid through the closed loop. The test loop was then loaded with 400 mL of the chemical cleaning solution to be tested, the temperature of the contents raised to 100° F., and the chemical cleaning solution pumped through the loop at a rate of approximately 200 mL/minute for 8 hours. The amount of dissolved iron in the cleaning solution was analyzed at the end of one hour and at the end of 8 hours using a commercial atomic absorption spectrophotometer. The results are summarized in Table I.

TABLE I

| Experiment | Solution | pH | Dissolved Iron (ppm) 1 Hour | 8 Hours | Comments |
|---|---|---|---|---|---|
| 1 | HEDTA | 1.2 | 960 | 4240 | 90% clean |
| 2 | HEDTA | 1.6 | 1200 | 3840 | 90% clean |
| 3 | EDTA* | 5.0 | 360 | 1200 | Much scale remaining |

*This solvent is an ammoniated ethylenediaminetetraacetic acid solution having a pH of 5 and is inhibited with a similar commercial amine-based corrosion inhibitor (Dowell A196).

The data from Table I show the HEDTA solutions to be far more effective in dissolving this predominantly iron oxide scale than the EDTA-based solution which is a commercial cleaning solvent.

EXPERIMENTS 4–7

In this series of experiments, the chemical cleaning ability of various solvents was measured by placing a one-inch "coupon" into a stirred autoclave containing 300 mL of the cleaning solution at 150° F. for 6 hours. The amount of dissolved iron was measured at the end of one hour and at the end of the test, 6 hours. The one-inch "coupons" were cut from a piece of drum boiler tubing which had been used in a forced circulation boiler.

The results from these tests are summarized in Table II.

TABLE II

| Experiment | Solution | pH | Dissolved Iron (ppm) 1 Hour | 6 Hours | Comments |
|---|---|---|---|---|---|
| 4 | HEDTA | 1.2 | 2080 | 2560 | Clean |
| 5 | HEDTA | 1.6 | 1760 | 2560 | Clean |
| 6 | HEDTA | 2.3 | 1280 | 2920 | Some scale remaining |
| 7 | EDTA* | 5.0 | 1420 | 3440 | Some scale remaining |

In this series of experiments, the solvents used in Experiments 4 and 5 correspond to the solvents used in Experiment 1 and 2, respectively. A solvent used in Experiment 6 is a 3 percent aqueous solution of HEDTA containing 0.3 percent of corrosion inhibitor, Dowell A175. The EDTA solvent from Experiment 7 corresponds to the solvent used in Experiment 3.

EXPERIMENTS 8–9

This series of experiments is similar to those immediately preceding except that the "coupons" were sections of tubing from a pressure boiler referred to as a drumless boiler or a "once-through" boiler. The types of scale are somewhat different. The results of the tests are shown on Table III.

TABLE III

| Experiment | Solution | pH | Dissolved Iron (ppm) 1 Hr. | 4 Hr. | 6 Hr. | Comments |
|---|---|---|---|---|---|---|
| 8 | HEDTA | 1.6 | 3040 | 4200 | — | clean/shiny |
| 9 | EDTA | 5.0 | 770 | — | 3220 | clean |

The solvents in Experiments 2 and 8 correspond and the solvents in Experiments 3 and 9 correspond. Experiments 8 and 9 were conducted at 150° F. for 4 and 6 hours, respectively. The data show that the HEDTA solution was far more effective than the EDTA-based commercial solvent in removing the type of scale encountered in drumless boilers.

EXPERIMENTS 10–12

In this similar series of experiments, "coupons" obtained from a super heat/reheat section of a boiler were used. The data from this series of tests is summarized in Table IV.

TABLE IV

| Experiment | Solution | pH | T (°F.) | Time (Hrs) | Dissolved Iron (ppm) |
|---|---|---|---|---|---|
| 10 | HEDTA | 1.2 | 150 | 9 | 9152 |
| 11 | HEDTA | 1.6 | 150 | 25 | 6136 |
| 12 | EDTA* | 5.0 | 200 | 25 | 7440 |

The solvents used in Experiments 10–12 correspond to the solvents used in Experiments 1–3, respectively. In each instance, visual observation of the "coupon" and the spent cleaning solution showed the coupon to be clean with a small amount of Iron Chromite adhering to the surface. The data in Table IV show the HEDTA solutions to be as effective or better than the commercial EDTA-based solvent even at lower temperatures against this heavy dense scale. The scale on super heater/reheater surfaces is probably one of the most difficult scales to remove. The HEDTA results are, therefore, excellent.

All of the dissolved iron figures presented in Tables I–IV were normalized to account for the difference in the weight of the "coupons".

EXPERIMENTS 13–14

An HEDTA solution was prepared (as per Experiment 2) at a pH of 1.6. The pH of this solution was raised with ammonium hydroxide to a pH of 9.2. One percent sodium nitrite was then added, based on the weight of the original HEDTA solution. A steel specimen which had been freshly cleaned with acid was then placed into this passivating solution for fifteen minutes. The steel specimen was then removed, rinsed with deionized water and hung up to dry. No after-rusting was observed. Additionally, while the steel specimen was in the passivating solution, the surface potential of the steel coupon was measured against the standard Calomel electrode, as per the test set forth in Teumac. This potential also indicated passivation had occurred.

In another passivation test, a steel coupon and a portion of a boiler tube which had been freshly cleaned with a HEDTA solution of pH 1.6 (as per Experiment 2) were rinsed and placed directly into hot water containing ammonia and 0.25 percent sodium nitrite for fifteen minutes. These metal articles were then removed, rinsed with deionized water, and hung up to dry. No after-rusting was observed. Similar results were achieved when the passivating solution contained 0.25 percent hydrazine instead of sodium nitrite.

EXPERIMENT 15

In a preoperational cleanup, one of two pipelines in a paper mill were cleaned by filling and circulating an aqueous solution containing 6 percent $Na_3$HEDTA and $H_2SO_4$ at pH about 1.6 and from 0.3 weight percent of a commercial acid corrosion inhibitor (Dowell A175). The temperature of the solution was maintained between 140° and 150° F. After only 1.5 hours, the dissolved iron content had risen to and remained stable at 0.2 percent. The concentration of the $Na_3$ HEDTA in the solution dropped to about 4 percent.

A fresh solution of $Na_3$ HEDTA/$H_2SO_4$ of like strength and inhibitor concentration was prepared and circulated through the second system at a temperature of from 140° to 150° F. After 1.5 hours, the amount of dissolved iron in the solution was 0.3 percent and the concentration of the $Na_3$ HEDTA had been reduced to about 3 percent and remained stable.

The pH of the cleaning solution used on the first pipeline was 1.56 and the pH used in cleaning the second system was 1.97. Sulfuric acid was used in each instance to adjust the pH to the indicated values.

Inspection of the cleaning system showed that the 0.01 inch thick deposit of dense magnetite had been completely removed from the pipeline. There remained, however, a gritty film on sections of the pipe. This grit was easily wiped off the pipe surface and was metallic in nature and could be picked up with a magnet. The customer was extremely pleased with the cleaning procedure. It was determined that the remaining material in the cleaning system could be removed by a "steam-blow" of the piping.

It should be noted that the surfaces cleaned were composed of a myriad of metals, including T11 steel, 410 stainless steel, 4140 Cadmium-plated 304 stainless steel, T22 steel, Stillite surfaces and lead-plated steel rings. These metal surfaces were cleaned free or substantially free of the dense magnetite encrustations without any apparent adverse effect to the base metal. The results achieved in this field trial were excellent.

What is claimed:

1. An aqueous acid composition which can remove iron oxide scale from ferrous metal surfaces, the composition having a pH of between about 1 and about 3, and comprising (a) hydroxyethylethylenediaminetriacetic acid (HEDTA) dissolved therein in an amount of at least about 1% by weight of the composition, and (b) a compatible acid corrosion inhibitor.

2. The composition defined by claim 1 additionally comprising a non-oxidizing inorganic acid.

3. The composition defined by claim 2 wherein said inorganic acid is HCl or $H_2SO_4$.

4. The composition defined by claim 3 wherein said inorganic acid is $H_2SO_4$.

5. The composition defined by claim 1 wherein said HEDTA is generated in situ.

6. The composition defined by claim 4 wherein said HEDTA is generated in situ; said pH is from about 1 to about 2; and said acid corrosion inhibitor is an organic amine-based acid corrosion inhibitor.

7. The composition defined by claim 1 wherein said pH is from about 1 to about 2.

8. The composition defined by claim 4 wherein said pH is from about 1 to about 2.

9. A process for removing a predominantly iron oxide scale from a ferrous metal surface, said process comprising contacting said scale with an aqueous acid composition defined by claim 1.

* * * * *